US011440331B2

(12) United States Patent
McGuinness et al.

(10) Patent No.: US 11,440,331 B2
(45) **Date of Patent: *Sep. 13, 2022**

(54) FLUID EJECTION DEVICE

(71) Applicant: HEWLETT-PACKARD DEVELOPMENT COMPANY, L.P., Fort Collins, CO (US)

(72) Inventors: Nick McGuinness, San Diego, CA (US); Lawrence H White, Corvallis, OR (US); Paul A Richards, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/068,443

(22) Filed: Oct. 12, 2020

(65) Prior Publication Data

US 2021/0023853 A1 Jan. 28, 2021

Related U.S. Application Data

(63) Continuation of application No. 16/141,907, filed on Sep. 25, 2018, now Pat. No. 10,828,908, which is a (Continued)

(51) Int. Cl.
*B41J 2/19* (2006.01)
*B41J 2/175* (2006.01)
(Continued)

(52) U.S. Cl.
CPC ..... *B41J 2/19* (2013.01); *B41J 2/1404* (2013.01); *B41J 2/175* (2013.01); *B41J 2/18* (2013.01);
(Continued)

(58) Field of Classification Search
CPC ... B41J 2/19; B41J 2/1404; B41J 2/175; B41J 2/18; B41J 2/1433; B41J 2002/14467; B41J 2202/11; B41J 2202/12
See application file for complete search history.

(56) References Cited

U.S. PATENT DOCUMENTS 5,956,062 A 9/1999 Omata et al.
6,244,694 B1 6/2001 Weber
(Continued)

FOREIGN PATENT DOCUMENTS

CN 103153627 A 6/2013
CN 102036829 B 10/2013
(Continued)

OTHER PUBLICATIONS

Kim, B.H. et al., "Effects of Trapped Air Bubbles on Frequency Responses of the Piezo-driven Inkjet Printheads and Visualization of the Bubbles Using Synchrotron X-ray", Jan. 2009, 1 pg.

*Primary Examiner* — Sharon Polk
(74) *Attorney, Agent, or Firm* — HP Inc. Patent Department

(57) ABSTRACT

A fluid ejection system may include a media transport assembly and a printhead assembly having a fluid ejection device opposite the media transport assembly. The fluid ejection device may include a drop ejecting element and a fluid ejection chamber containing the drop ejection element. The fluid ejection chamber has an inlet and an outlet for fluid circulation through the fluid ejection chamber across the drop ejecting element. A particle tolerant architecture is between the inlet and the drop ejecting element.

18 Claims, 6 Drawing Sheets

Related U.S. Application Data continuation of application No. 15/541,963, filed as application No. PCT/US2015/013520 on Jan. 29, 2015, now Pat. No. 10,112,407.

(51) Int. Cl.
*B41J 2/14* (2006.01)
*B41J 2/18* (2006.01)

(52) U.S. Cl.
CPC .... *B41J 2/1433* (2013.01); *B41J 2002/14467* (2013.01); *B41J 2202/11* (2013.01); *B41J 2202/12* (2013.01)

(56) References Cited

U.S. PATENT DOCUMENTS

| | | | | |
|---|---|---|---|---|
| 6,270,201 | B1 | 8/2001 | Kasperchik | |
| 6,286,941 | B1 | 9/2001 | Courian et al. | |
| 6,331,050 | B1 | 12/2001 | Nakata | |
| 6,364,466 | B1 | 4/2002 | Chen et al. | |
| 6,364,467 | B1 | 4/2002 | Blair et al. | |
| 6,752,493 | B2 | 6/2004 | Dowell et al. | |
| 8,721,061 | B2 | 5/2014 | Govyadinov et al. | |
| 10,112,407 | B2 | 10/2018 | Mcguinness | |
| 10,828,908 | B2 * | 11/2020 | McGuinness | B41J 2/175 |
| 2006/0268071 | A1 | 11/2006 | Fellner et al. | |
| 2011/0128335 | A1 | 6/2011 | Von et al. | |
| 2011/0128355 | A1 | 6/2011 | Von Essen et al. | |
| 2011/0181674 | A1 | 7/2011 | Kang et al. | |
| 2012/0007921 | A1 | 1/2012 | Govyadinov et al. | |
| 2013/0076835 | A1 | 3/2013 | Oikawa | |
| 2013/0155152 | A1 | 6/2013 | Govyadinov | |
| 2013/0278688 | A1 | 10/2013 | Bibl | |
| 2014/0204148 | A1 | 7/2014 | Ge et al. | |
| 2014/0354717 | A1 | 12/2014 | Bibl | |
| 2015/0049141 | A1 | 2/2015 | Taff | |
| 2018/0022106 | A1 | 1/2018 | Govyadinov | |

FOREIGN PATENT DOCUMENTS

| | | | | |
|---|---|---|---|---|
| CN | 103502013 | A | 1/2014 | |
| CN | 103619605 | A | 3/2014 | |
| JP | 2005-153435 | | 6/2005 | |
| JP | 2006-123188 | | 5/2006 | |
| JP | 2007-176159 | | 7/2007 | |
| JP | 2011-152535 | A | 8/2011 | |
| JP | 2013-529566 | | 7/2013 | |
| JP | 2014514190 | | 6/2014 | |
| JP | 2014522754 | A | 9/2014 | |
| JP | 2014-188755 | | 10/2014 | |
| TW | 201425056 | A | 7/2014 | |
| WO | WO-2013002762 | | 3/2013 | |
| WO | WO-2013130039 | | 9/2013 | |
| WO | WO-2014084843 | | 6/2014 | |
| WO | WO-2014007814 | | 9/2014 | |
| WO | WO-2016122528 | A1 * | 8/2016 | B41J 2/19 |
| WO | WO-2018136097 | A1 * | 7/2018 | B41J 2/1404 |

* cited by examiner

FLUID EJECTION DEVICE

The present application is a continuation application claiming priority under 35 USC § 120 from co-pending U.S. patent application Ser. No. 16/141,907 filed on Sep. 25, 2018 which is a continuation of U.S. patent application Ser. No. 15/541,963 filed on Jul. 6, 2017 which claimed priority from PCT patent application PCT/US2015/013520 filed on Jan. 29, 2015, the full disclosures all of which are hereby incorporated by reference.

BACKGROUND

Fluid ejection devices, such as printheads in inkjet printing systems, may use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead and the print medium move relative to each other.

Air bubbles or other particles can negatively impact operation of a fluid ejection device. For example, air bubbles or other particles in an ejection chamber of a printhead may disrupt the ejection of drops from the ejection chamber, thereby resulting in misdirection of drops from the printhead or missing drops. Such disruption of drops may result in print defects and degrade print quality.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
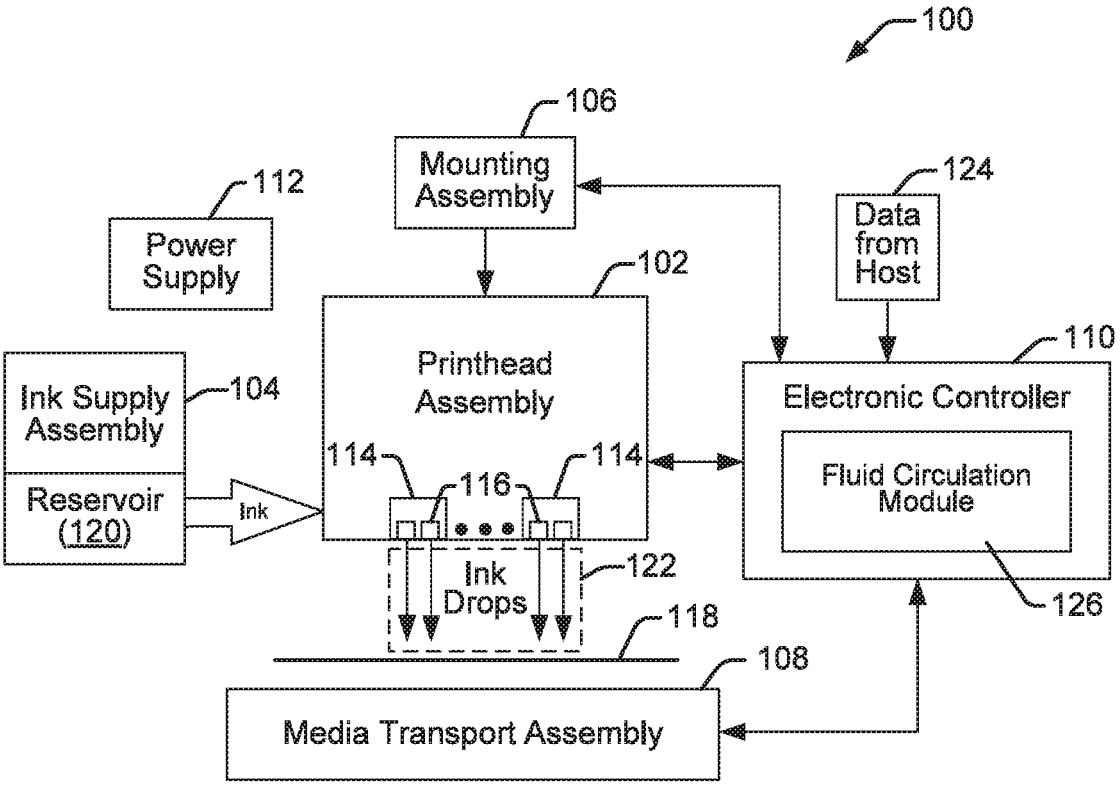
FIG. 1 is a block diagram illustrating one example of an inkjet printing system including an example of a fluid ejection device.

FIG. 1 illustrates one example of an inkjet printing system as an example of a fluid ejection device with fluid circulation, as disclosed herein. Inkjet printing system 100 includes a printhead assembly 102, an ink supply assembly 104, a mounting assembly 106, a media transport assembly 108, an electronic controller 110, and at least one power supply 112 that provides power to the various electrical components of inkjet printing system 100. Printhead assembly 102 includes at least one fluid ejection assembly 114 (printhead 114) that ejects drops of ink through a plurality of orifices or nozzles 116 toward a print medium 118 so as to print on print media 118.

Print media 118 can be any type of suitable sheet or roll material, such as paper, card stock, transparencies, Mylar, and the like. Nozzles 116 are typically arranged in one or more columns or arrays such that properly sequenced ejection of ink from nozzles 116 causes characters, symbols, and/or other graphics or images to be printed on print media 118 as printhead assembly 102 and print media 118 are moved relative to each other.

Ink supply assembly 104 supplies fluid ink to printhead assembly 102 and, in one example, includes a reservoir 120 for storing ink such that ink flows from reservoir 120 to printhead assembly 102. Ink supply assembly 104 and printhead assembly 102 can form a one-way ink delivery system or a recirculating ink delivery system. In a one-way ink delivery system, substantially all of the ink supplied to printhead assembly 102 is consumed during printing. In a recirculating ink delivery system, only a portion of the ink supplied to printhead assembly 102 is consumed during printing. Ink not consumed during printing is returned to ink supply assembly 104.

In one example, printhead assembly 102 and ink supply assembly 104 are housed together in an inkjet cartridge or pen. In another example, ink supply assembly 104 is separate from printhead assembly 102 and supplies ink to printhead assembly 102 through an interface connection, such as a supply tube. In either example, reservoir 120 of ink supply assembly 104 may be removed, replaced, and/or refilled. Where printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions printhead assembly 102 relative to media transport assembly 108, and media transport assembly 108 positions print media 118 relative to printhead assembly 102. Thus, a print zone 122 is defined adjacent to nozzles 116 in an area between printhead assembly 102 and print media 118. In one example, printhead assembly 102 is a scanning type printhead assembly. As such, mounting assembly 106 includes a carriage for moving printhead assembly 102 relative to media transport assembly 108 to scan print media 118. In another example, printhead assembly 102 is a non-scanning type printhead assembly. As such, mounting assembly 106 fixes printhead assembly 102 at a prescribed position relative to media transport assembly 108. Thus, media transport assembly 108 positions print media 118 relative to printhead assembly 102.

Electronic controller 110 typically includes a processor, firmware, software, one or more memory components including volatile and non-volatile memory components, and other printer electronics for communicating with and controlling printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one example, electronic controller 110 controls printhead assembly 102 for ejection of ink drops from nozzles 116. Thus, electronic controller 110 defines a pattern of ejected ink drops which form characters, symbols, and/or other graphics or images on print media 118. The pattern of ejected ink drops is determined by the print job commands and/or command parameters.

Printhead assembly 102 includes one or more printheads 114. In one example, printhead assembly 102 is a wide-array or multi-head printhead assembly. In one implementation of a wide-array assembly, printhead assembly 102 includes a carrier that carries a plurality of printheads 114, provides electrical communication between printheads 114 and electronic controller 110, and provides fluidic communication between printheads 114 and ink supply assembly 104.

In one example, inkjet printing system 100 is a drop-on-demand thermal inkjet printing system wherein printhead 114 is a thermal inkjet (TIJ) printhead. The thermal inkjet printhead implements a thermal resistor ejection element in an ink chamber to vaporize ink and create bubbles that force ink or other fluid drops out of nozzles 116. In another example, inkjet printing system 100 is a drop-on-demand piezoelectric inkjet printing system wherein printhead 114 is a piezoelectric inkjet (PIJ) printhead that implements a piezoelectric material actuator as an ejection element to generate pressure pulses that force ink drops out of nozzles 116.

In one example, electronic controller 110 includes a flow circulation module 126 stored in a memory of controller 110. Flow circulation module 126 executes on electronic controller 110 (i.e., a processor of controller 110) to control the operation of one or more fluid actuators integrated as pump elements within printhead assembly 102 to control circulation of fluid within printhead assembly 102.

Figure 2:
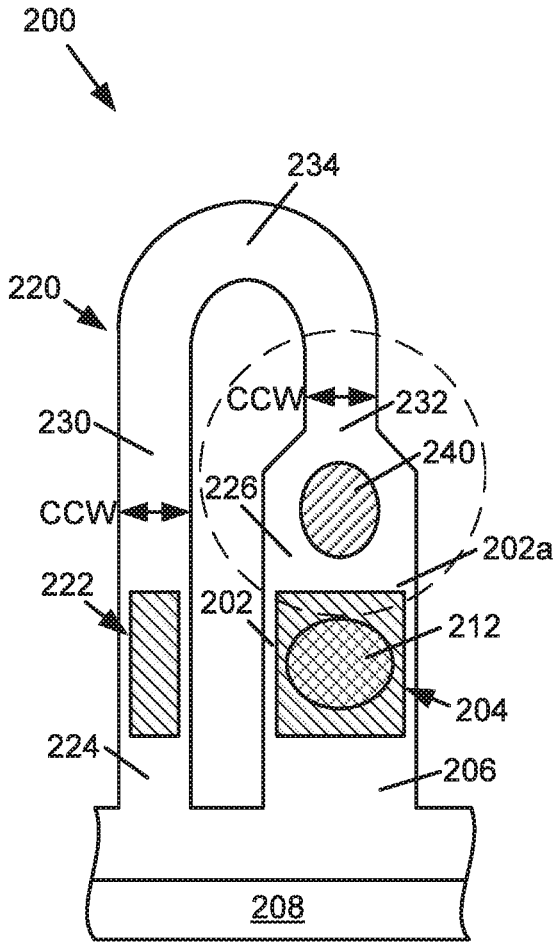
FIG. 2 is a schematic plan view illustrating one example of a portion of a fluid ejection device including one example of a particle tolerant architecture.

FIG. 2 is a schematic plan view illustrating one example of a portion of a fluid ejection device 200. Fluid ejection device 200 includes a fluid ejection chamber 202 and a corresponding drop ejecting element 204 formed in, provided within, or communicated with fluid ejection chamber 202. Fluid ejection chamber 202 and drop ejecting element 204 are formed on a substrate 206 which has a fluid (or ink) feed slot 208 formed therein such that fluid feed slot 208 provides a supply of fluid (or ink) to fluid ejection chamber 202 and drop ejecting element 204. Substrate 206 may be formed, for example, of silicon, glass, or a stable polymer.

In one example, fluid ejection chamber 202 is formed in or defined by a barrier layer (not shown) provided on substrate 206, such that fluid ejection chamber 202 provides a "well" in the barrier layer. The barrier layer may be formed, for example, of a photoimageable epoxy resin, such as SU8.

In one example, a nozzle or orifice layer (not shown) is formed or extended over the barrier layer such that a nozzle opening or orifice 212 formed in the orifice layer communicates with a respective fluid ejection chamber 202. Nozzle opening or orifice 212 may be of a circular, non-circular, or other shape.

Drop ejecting element 204 can be any device capable of ejecting fluid drops through corresponding nozzle opening or orifice 212. Examples of drop ejecting element 204 include a thermal resistor or a piezoelectric actuator. A thermal resistor, as an example of a drop ejecting element, is typically formed on a surface of a substrate (substrate 206), and includes a thin-film stack including an oxide layer, a metal layer, and a passivation layer such that, when activated, heat from the thermal resistor vaporizes fluid in fluid ejection chamber 202, thereby causing a bubble that ejects a drop of fluid through nozzle opening or orifice 212. A piezoelectric actuator, as an example of a drop ejecting element, generally includes a piezoelectric material provided on a moveable membrane communicated with fluid ejection chamber 202 such that, when activated, the piezoelectric material causes deflection of the membrane relative to fluid ejection chamber 202, thereby generating a pressure pulse that ejects a drop of fluid through nozzle opening or orifice 212.

As illustrated in the example of FIG. 2, fluid ejection device 200 includes a fluid circulation channel 220 and a fluid circulating element 222 formed in, provided within, or communicated with fluid circulation channel 220. Fluid circulation channel 220 is open to and communicates at one end 224 with fluid feed slot 208 and is open to and communicates at another end 226 with fluid ejection chamber 202. In one example, end 226 of fluid circulation channel 220 communicates with fluid ejection chamber 202 at an end 202*a* of fluid ejection chamber 202.

Fluid circulating element 222 forms or represents an actuator to pump or circulate (or recirculate) fluid through fluid circulation channel 220. As such, fluid from fluid feed slot 208 circulates (or recirculates) through fluid circulation channel 220 and fluid ejection chamber 202 based on flow induced by fluid circulating element 222. Circulating (or recirculating) fluid through fluid ejection chamber 202 helps to reduce ink blockage and/or clogging in fluid ejection device 200.

As illustrated in the example of FIG. 2, fluid circulation channel 220 communicates with one (i.e., a single) fluid ejection chamber 202, as communicated with one (i.e., a single) nozzle opening or orifice 212. As such, fluid ejection device 200 has a 1:1 nozzle-to-pump ratio, where fluid circulating element 222 is referred to as a "pump" which induces fluid flow through fluid circulation channel 220 and fluid ejection chamber 202. With a 1:1 ratio, circulation is individually provided for each fluid ejection chamber 202. Other nozzle-to-pump ratios (e.g., 2:1, 3:1, 4:1, etc.) are also possible, where one fluid circulating element induces fluid flow through a fluid circulation channel communicated with multiple fluid ejection chambers and, therefore, multiple nozzle openings or orifices.

In the example illustrated in FIG. 2, drop ejecting element 204 and fluid circulating element 222 are both thermal resistors. Each of the thermal resistors may include, for example, a single resistor, a split resistor, a comb resistor, or multiple resistors. A variety of other devices, however, can also be used to implement drop ejecting element 204 and fluid circulating element 222 including, for example, a piezoelectric actuator, an electrostatic (MEMS) membrane, a mechanical/impact driven membrane, a voice coil, a magneto-strictive drive, and so on.

As illustrated in the example of FIG. 2, fluid ejection device 200 includes a particle tolerant architecture 240. In one example, particle tolerant architecture 240 is formed within fluid circulation channel 220 toward or at end 226 of fluid circulation channel 220. Particle tolerant architecture 240 includes, for example, a pillar, a column, a post or other structure (or structures) formed in or provided within fluid circulation channel 220.

In one example, particle tolerant architecture 240 forms an "island" in fluid circulation channel 220 which allows fluid to flow therearound and into fluid ejection chamber 202 while preventing particles, such as air bubbles or other particles (e.g., dust, fibers), from flowing into fluid ejection chamber 202 through fluid circulation channel 220. Such particles, if allowed to enter fluid ejection chamber 202, may affect a performance of fluid ejection device 200. In addition, particle tolerant architecture 240 also prevents particles from flowing into fluid circulation channel 220 and, therefore, to fluid circulating element 222 from fluid ejection chamber 202.

In one example, fluid circulation channel 220 is a U-shaped channel and includes a channel portion 230 communicated with fluid feed slot 208, a channel portion 232 communicated with fluid ejection chamber 202, and a channel loop portion 234 provided between channel portion 230 and channel portion 232. As such, in one example, fluid in fluid circulation channel 220 circulates (or recirculates) between fluid feed slot 208 and fluid ejection chamber 202 through channel portion 230, channel loop portion 234, and channel portion 232.

In the example illustrated in FIG. 2, fluid circulating element 222 is formed in, provided within, or communicated with channel portion 230, and particle tolerant architecture 240 is formed in or provided within channel portion 232. As such, in one example, fluid circulating element 222 is provided within fluid circulation channel 220 between fluid feed slot 208 and channel loop portion 234, and particle tolerant architecture 240 is provided within fluid circulation channel 220 between channel loop portion 234 and fluid ejection chamber 202. In one example, as described below, to accommodate particle tolerant architecture 240 within fluid circulation channel 220 and minimize or avoid restriction of fluid flow through fluid circulation channel 220 at particle tolerant architecture 240, a width of fluid circulation channel 220 is increased at particle tolerant architecture 240.

Figure 3:
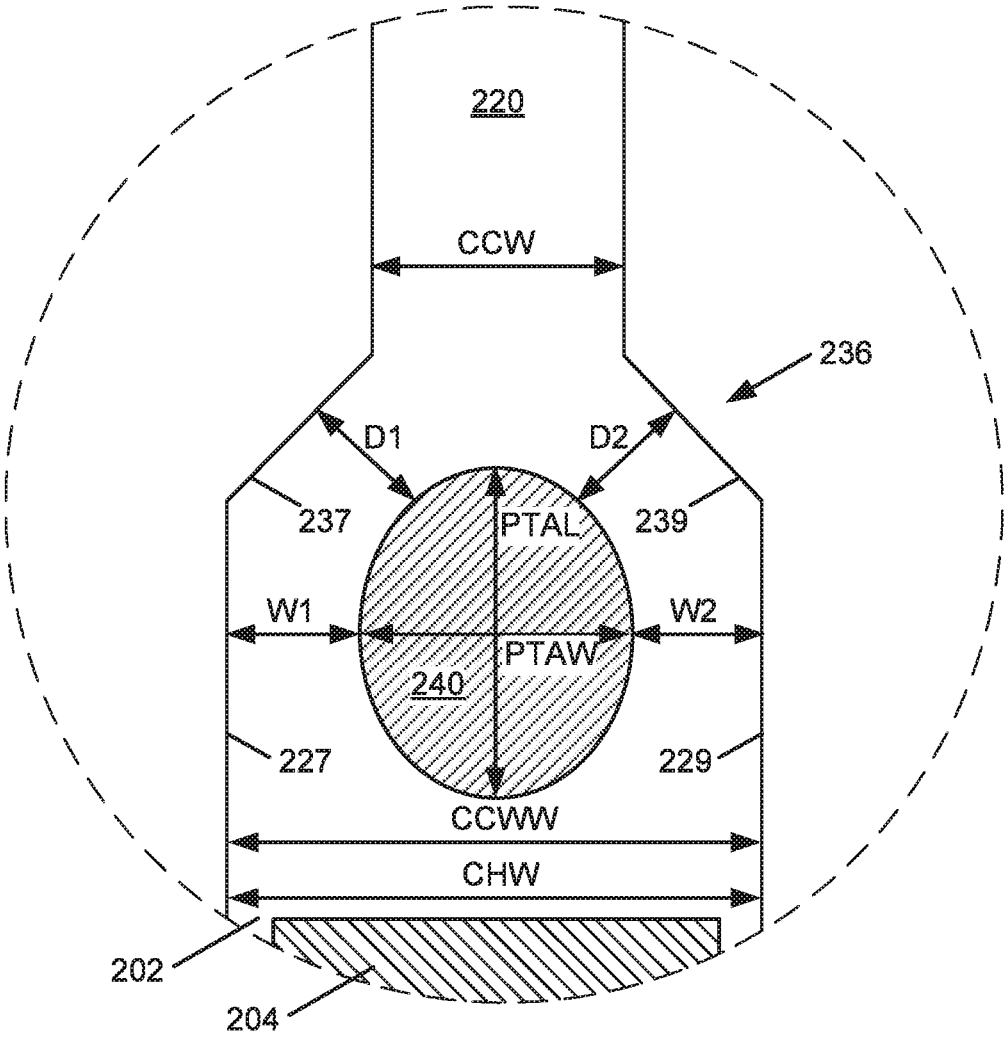
FIG. 3 is an enlarged view of the area within the broken line circle of FIG. 2.

FIG. 3 is an enlarged view of the area within the broken line circle of FIG. 2. As illustrated in the example of FIG. 3, fluid ejection chamber 202 has a chamber width (CHW), and fluid circulation channel 220 has a circulation channel width (CCW). In addition, particle tolerant architecture 240 has a width (PTAW) and a length (PTAL). In one example, to accommodate particle tolerant architecture 240, a width of fluid circulation channel 220 is increased at particle tolerant architecture 240. More specifically, in one example, at a position of particle tolerant architecture 240, fluid circulation channel 220 has an increased circulation channel width (CCWW). As such, fluid circulation channel 220 has a circulation channel width (CCW) at fluid circulating element 222 (FIG. 2), and an increased circulation channel width (CCWW) at particle tolerant architecture 240. Thus, in one example, circulation channel width (CCW) extends from channel portion 230, including end 224 as open to and communicated with fluid feed slot 208, and through channel loop portion 234 to channel portion 232, and increased circulation channel width (CCWW) extends from channel portion 232 to fluid ejection chamber 202.

In one example, fluid circulation channel 220 includes a transition portion 236 between circulation channel width (CCW) and increased circulation channel width (CCWW) such that, in one example, transition portion 236 diverges from circulation channel width (CCW) to increased circulation channel width (CCWW). As such, between channel loop portion 234 and fluid ejection chamber 202, fluid circulation channel 220 increases from circulation channel width (CCW) to increased circulation channel width (CCWW).

In one example, to prevent particles from flowing into fluid ejection chamber 202 from fluid circulation channel 220, a minimum distance (D1) between particle tolerant architecture 240 and a sidewall 237 of transition portion 236 of fluid circulation channel 220, and a minimum distance (D2) between particle tolerant architecture 240 and a sidewall 239 of transition portion 236 of fluid circulation channel 220 are each less than circulation channel width (CCW) (i.e., D1<CCW, D2<CCW).

In one example, to maintain volumetric fluid flow through fluid circulation channel 220 and minimize or avoid restriction of fluid flow through fluid circulation channel 220 at particle tolerant architecture 240, circulation channel width (CCW) is maintained (or generally maintained) around and/or along particle tolerant architecture 240. As such, in one example, a sum of a minimum distance between particle tolerant architecture 240 and a sidewall 227 of fluid circulation channel 220 at a first side of particle tolerant architecture 240, and a minimum distance between particle tolerant architecture 240 and a sidewall 229 of fluid circulation channel 220 at a second side of particle tolerant architecture 240 is substantially equal to circulation channel width (CCW). More specifically, in one example, a sum of a width (W1) at a first side of particle tolerant architecture 240 and a width (W2) at a second side of particle tolerant architecture 240 is substantially equal to circulation channel width (CCW) (i.e., W1+W2=CCW). In addition, in one example, a sum of distance (D1) between particle tolerant architecture 240 and sidewall 237 of transition portion 236 of fluid circulation channel 220, and distance (D2) between particle tolerant architecture 240 and sidewall 239 of transition portion 236 of fluid circulation channel 220 is substantially equal to circulation channel width (CCW) (i.e., D1+D2=CCW).

In another example, a sum of width (W1) at a first side of particle tolerant architecture 240 and width (W2) at a second side of particle tolerant architecture 240 is less than circulation channel width (CCW) (i.e., W1+W2<CCW) and, in another example, with width (W1) at a first side of particle tolerant architecture 240 and width (W2) at a second side of particle tolerant architecture 240 each being less than circulation channel width (CCW), a sum of width (W1) and width (W2) is greater than circulation channel width (CCW) (i.e., W1<CCW, W2<CCW, W1+W2>CCW).

In one example, increased circulation channel width (CCWW) includes width (PTAW) of particle tolerant architecture 240, width (W1) between particle tolerant architecture 240 and sidewall 227 of fluid circulation channel 220 at a first side of particle tolerant architecture 240, and width (W2) between particle tolerant architecture 240 and sidewall 229 of fluid circulation channel 220 at a second side of particle tolerant architecture 240 (i.e., CCWW=PTAW+W1+W2). In addition, in one example, increased circulation channel width (CCWW) is substantially equal to chamber width (CHW) (i.e., CCWW=CHW). In another example, increased circulation channel width (CCWW) is less than chamber width (CHW) (i.e., CCWW<CHW).

In one example, particle tolerant architecture 240 is of a closed curve shape. For example, as illustrated in FIGS. 2 and 3, particle tolerant architecture 240 has an elliptical shape. Particle tolerant architecture 240, however, may be other closed curve shapes such as, for example, a circle or an oval.

With a closed curve shape of particle tolerant architecture 240, width (W1) is defined at a maximum width of particle tolerant architecture 240 between a perimeter of particle tolerant architecture 240 at one side of particle tolerant architecture 240 and sidewall 227 of fluid circulation channel 220, and width (W2) is defined at the maximum width of particle tolerant architecture 240 between a perimeter of particle tolerant architecture 240 at an opposite side of particle tolerant architecture 240 and sidewall 229 of fluid circulation channel 220. In addition, distance (D1) is defined between a perimeter of particle tolerant architecture 240 and sidewall 237 of fluid circulation channel 220, and distance (D2) is defined between a perimeter of particle tolerant architecture 240 and sidewall 239 of fluid circulation channel 220.

Figure 4:
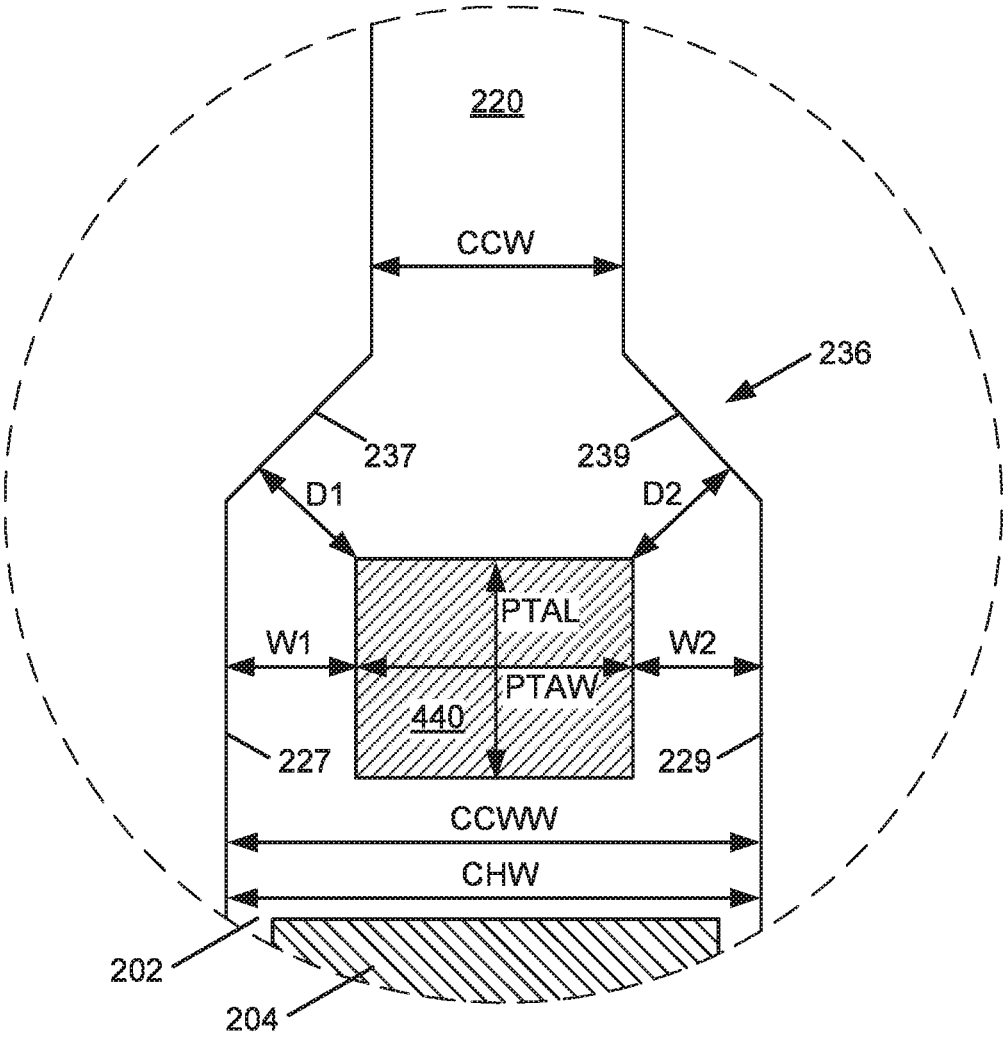
FIG. 4 is an enlarged view illustrating another example of a portion of a fluid ejection device including another example of a particle tolerant architecture.

FIG. 4 is an enlarged view illustrating another example of a portion of fluid ejection device 200 including another example of a particle tolerant architecture 440. In the example illustrated in FIG. 4, particle tolerant architecture 440 has a rectangular shape, as an example of a polygonal shape. As a rectangular shape, particle tolerant architecture 440 may be, for example, a rectangle or a square. Particle tolerant architecture 440, however, may also be other polygonal shapes.

With a rectangular shape of particle tolerant architecture 440, width (W1) is defined between one side of particle tolerant architecture 440 and sidewall 227 of fluid circulation channel 220, and width (W2) is defined between an opposite side of particle tolerant architecture 440 and sidewall 229 of fluid circulation channel 220. In addition, distance (D1) is defined between one corner of particle tolerant architecture 440 and sidewall 237 of fluid circulation channel 220, and distance (D2) is defined between an adjacent corner of particle tolerant architecture 440 and sidewall 239 of fluid circulation channel 220.

Figure 5:
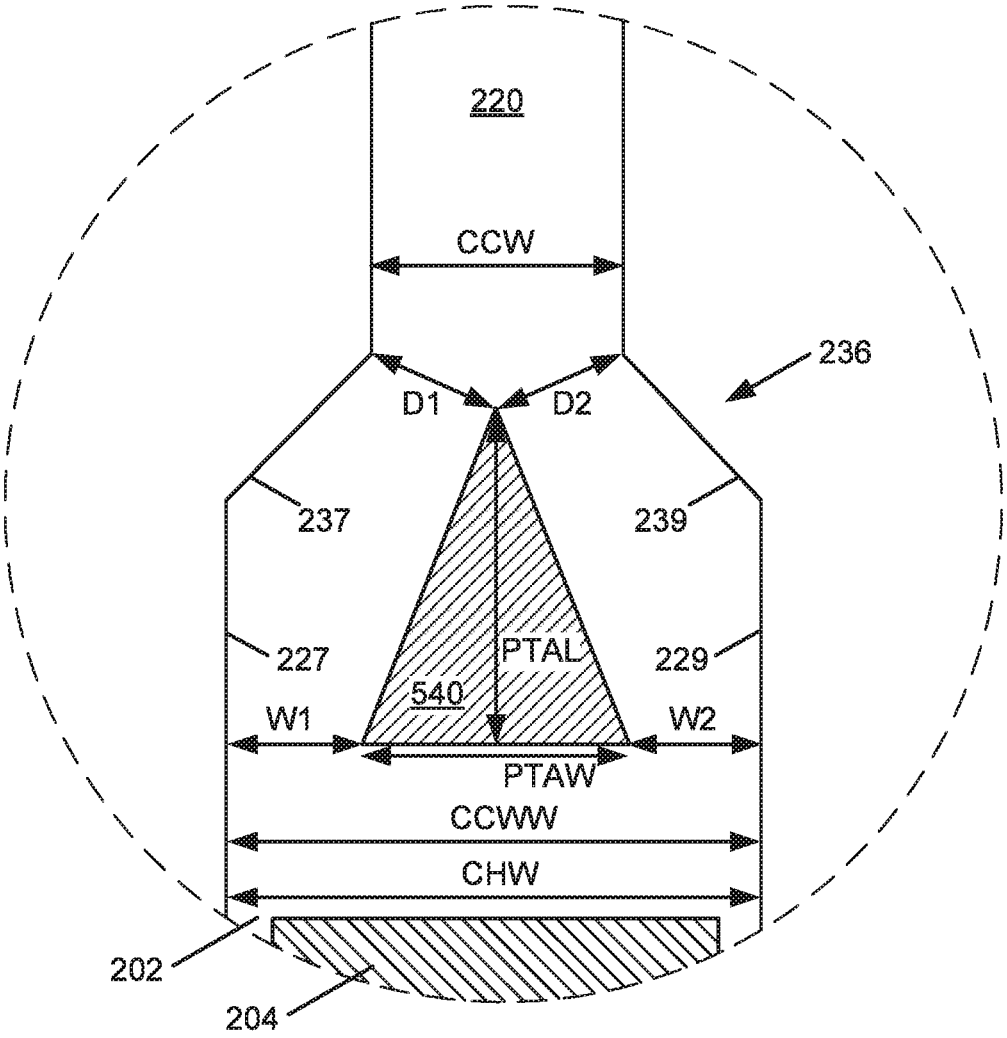
FIG. 5 is an enlarged view illustrating another example of a portion of a fluid ejection device including another example of a particle tolerant architecture.

FIG. 5 is an enlarged view illustrating another example of a portion of fluid ejection device 200 including another example of a particle tolerant architecture 540. In the example illustrated in FIG. 5, particle tolerant architecture 540 has a triangular shape, as an example of a polygonal shape.

With a triangular shape of particle tolerant architecture 540, width (W1) is defined at a base of particle tolerant architecture 540 between one vertex of particle tolerant architecture 540 and sidewall 227 of fluid circulation channel 220, and width (W2) is defined at the base of particle tolerant architecture 540 between an adjacent vertex of particle tolerant architecture 540 and sidewall 229 of fluid circulation channel 220. In addition, distance (D1) is defined between a vertex of particle tolerant architecture 540 (opposite the base of particle tolerant architecture 540) and sidewall 237 of fluid circulation channel 220), and distance (D2) is defined between the vertex of particle tolerant architecture 540 (opposite the base of particle tolerant architecture 540) and sidewall 239 of fluid circulation channel 220.

Figure 6:
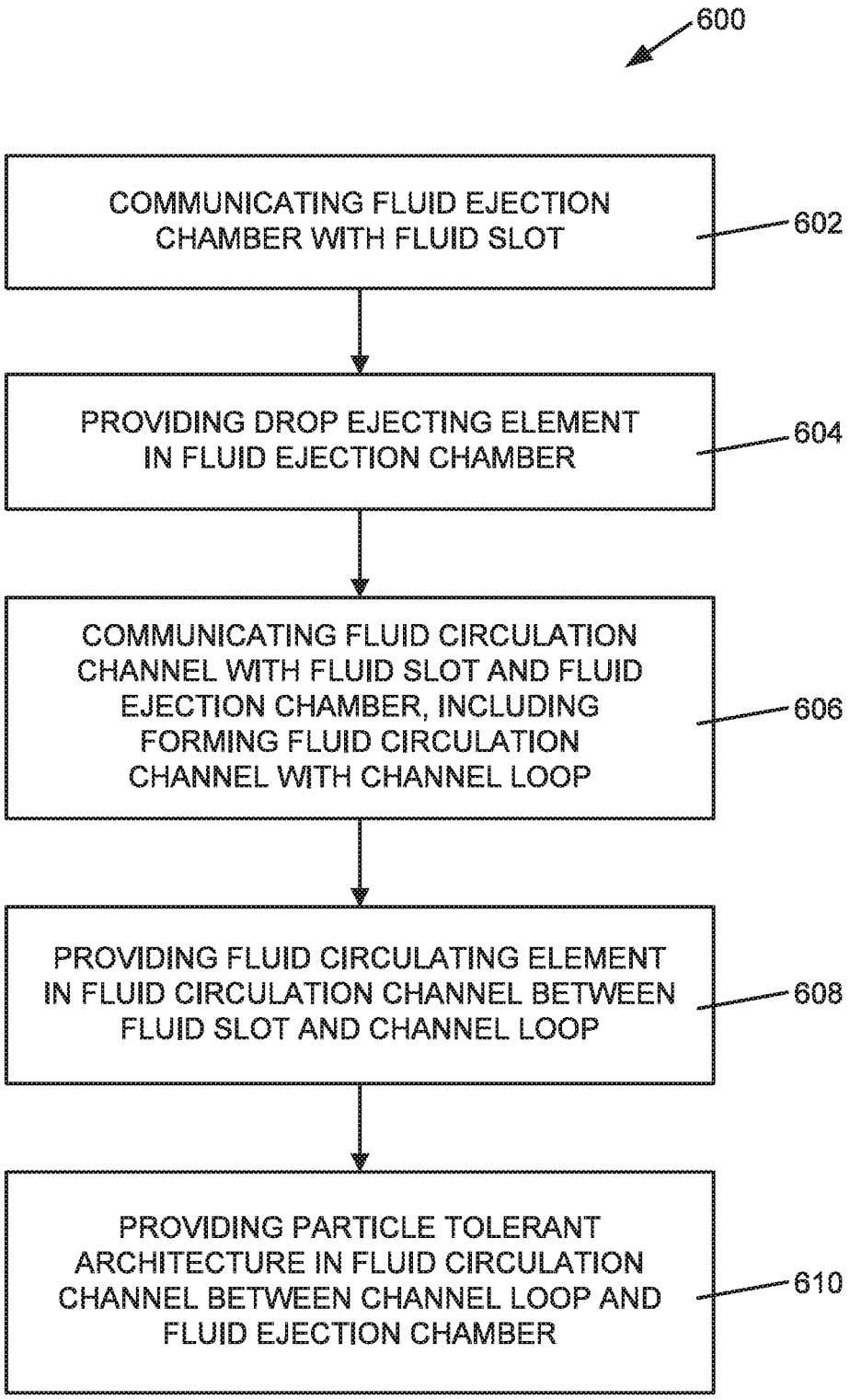
FIG. 6 is a flow diagram illustrating one example of a method of forming a fluid ejection device.

FIG. 6 is a flow diagram illustrating one example of a method 600 of forming a fluid ejection device, such as fluid ejection device 200 as illustrated in the examples of FIGS. 2 and 3, 4, and 5.

At 602, method 600 includes communicating a fluid ejection chamber, such as fluid ejection chamber 202, with a fluid slot, such as fluid feed slot 208.

At 604, method 600 includes providing a drop ejecting element, such as drop ejecting element 204, in the fluid ejection chamber, such as fluid ejection chamber 202.

At 606, method 600 includes communicating a fluid circulation channel, such as fluid circulation channel 220, with the fluid slot and the fluid ejection chamber, such as fluid feed slot 208 and fluid ejection chamber 202. In this regard, 606 of method 600 includes forming the fluid circulation channel, such as fluid circulation channel 220, with a channel loop, such as channel loop portion 234.

At 608, method 600 includes providing a fluid circulating element, such as fluid circulating element 222, in the fluid circulation channel, such as fluid circulation channel 220, between the fluid slot and the channel loop, such as fluid feed slot 208 and channel loop portion 234.

At 610, method 600 includes providing a particle tolerant architecture, such as particle tolerant architecture 240, 440, 540, in the fluid circulation channel, such as fluid circulation channel 220, between the channel loop and the fluid ejection chamber, such as channel loop portion 234 and fluid ejection chamber 202.

Although illustrated and described as separate and/or sequential steps, the method of forming the fluid ejection device may include a different order or sequence of steps, and may combine one or more steps or perform one or more steps concurrently, partially or wholly.

With a fluid ejection device including circulation (or recirculation) of fluid as described herein, ink blockage and/or clogging is reduced. As such, decap time (i.e., an amount of time inkjet nozzles can remain uncapped and exposed to ambient conditions) and, therefore, nozzle health are improved. In addition, pigment-ink vehicle separation and viscous ink plug formation within the fluid ejection device are reduced or eliminated. Furthermore, ink efficiency is improved by lowering ink consumption during servicing (e.g., minimizing spitting of ink to keep nozzles healthy).

More importantly, including particle tolerant architecture in the fluid circulation channel as described herein, helps to prevent air bubbles and/or other particles from entering the fluid ejection chamber from the fluid circulation channel during circulation (or recirculation) of fluid through the fluid circulation channel and the fluid ejection chamber. As such, disruption of the ejection of drops from the fluid ejection chamber is reduced or eliminated. In addition, the particle tolerant architecture also helps to prevent air bubbles and/or other particles from entering the fluid circulation channel from the fluid ejection chamber.

In one example, by maintaining a width of the fluid circulation channel around and/or along the particle tolerant architecture (e.g., width (W1) and width (W2) and distance (D1) and distance (D2) between the particle tolerant architecture and sidewalls of the fluid circulation channel), restriction of fluid flow through the fluid circulation channel at the particle tolerant architecture is minimized or avoided, and volumetric fluid flow through the fluid circulation channel is (substantially) maintained.

Furthermore, by providing particle tolerant architecture toward or at an end of the fluid circulation channel communicated with the fluid ejection chamber, the particle tolerant architecture helps to increase back pressure and, therefore, increase firing momentum of the ejection of drops from the fluid ejection chamber by helping to contain the drive energy of the drop ejection in the fluid ejection chamber.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. A fluid ejection system comprising:

a media transport assembly;

a printhead assembly opposite the media transport assembly, the printhead assembly comprising a fluid ejection device, the fluid ejection device comprising:

a drop ejecting element;

a fluid ejection chamber containing the drop ejecting element, the fluid ejection chamber having an inlet and an outlet for fluid circulation through the fluid ejection chamber across the drop ejecting element; and a particle tolerant architecture between the inlet and the drop ejecting element.

2. The fluid ejection system of claim 1, wherein the drop ejecting element is between the inlet and the outlet of the fluid ejection chamber.

3. The fluid ejection system of claim 1, further comprising a fluid circulation channel having a first end fluidically connected to a fluid source and an opposite second end connected to the inlet of the fluid ejection chamber, wherein the outlet of the fluid ejection chamber is connected to the fluid source.

4. The fluid ejection system of claim 3, wherein the fluid source comprises a fluid slot.

5. The fluid ejection system of claim 3, wherein the fluid circulation channel includes a first portion and a second portion having the particle tolerant architecture therein, the first portion having a first width and the second portion having a second width greater than the first width at the particle tolerant architecture.

6. The fluid ejection system of claim 5, wherein a minimum distance between the particle tolerant architecture and a first sidewall of the second portion of the fluid circulation channel and a minimum distance between the particle tolerant architecture and a second sidewall of the second portion of the fluid circulation channel are each less than the first width of the first portion of the fluid circulation channel.

7. The fluid ejection system of claim 5, wherein the fluid circulation channel includes a third portion between the first portion and the second portion, the third portion diverging from the first width of the first portion to the second width of the second portion.

8. The fluid ejection system of claim 7, wherein a minimum distance between the particle tolerant architecture and a first sidewall of the third portion of the fluid circulation channel and a minimum distance between the particle tolerant architecture and a second sidewall of the third portion of the fluid circulation channel are each less than the first width of the first portion of the fluid circulation channel.

9. The fluid ejection system of claim 3, further comprising a fluid circulating element, wherein the fluid circulation channel includes a first portion having the fluid circulating element therein and a second portion having the particle tolerant architecture therein, the first portion having a first width at the fluid circulating element and the second portion having a second width greater than the first width at the particle tolerant architecture.

10. The fluid ejection system of claim 1, wherein the particle tolerant architecture comprises a closed curve shape.

11. The fluid ejection system of claim 1, wherein the particle tolerant architecture comprises a polygonal shape.

12. The fluid ejection system of claim 1, further comprising a controller, wherein the controller is to operate in a fluid circulation mode causing fluid circulation through the fluid circulation channel.

13. The fluid ejection system of claim 1, further comprising a fluid supply assembly to supply fluid to the printhead assembly.

14. The fluid ejection system of claim 1, further comprising a controller, the controller to receive data from a host and to output control signals to the drop ejecting element based upon the data.

15. The fluid ejection system of claim 1, wherein the media transport assembly is to position portions of a roll of media opposite the printhead assembly.

16. The fluid ejection system of claim 1, wherein the particle tolerant architecture is located proximate to the drop ejecting element so as to increase back pressure within the fluid ejection chamber and to contain drive energy of a drop ejection in the fluid ejection chamber.

17. A fluid ejection system, comprising:

a media transport assembly;

a printhead assembly opposite the media transport assembly, the printhead assembly comprising a fluid ejection device, the fluid ejection device comprising:

a fluid slot;

a fluid ejection chamber communicated with the fluid slot;

a drop ejecting element within the fluid ejection chamber;

a fluid circulation channel including a channel loop, and communicated with the fluid slot and the fluid ejection chamber; and a particle tolerant architecture within the fluid circulation channel between the channel loop and the fluid ejection chamber.

18. The fluid ejection system of claim 17, wherein a width of the fluid circulation channel is increased at the particle tolerant architecture.

* * * * *